US008721313B2

(12) United States Patent
Pokorny et al.

(10) Patent No.: US 8,721,313 B2
(45) Date of Patent: May 13, 2014

(54) APPARATUS FOR PRODUCTION OF TWO-DIMENSIONAL OR THREE-DIMENSIONAL FIBROUS MATERIALS OF MICROFIBRES AND NANOFIBRES

(75) Inventors: Marek Pokorny, Kosmonosy (CZ); Vladimir Velebny, Zamberk (CZ)

(73) Assignee: Contipro Biotech s.r.o., Dolni Dobrouc (CZ)

( * ) Notice: Subject to any disclaimer, the term of this patent is extended or adjusted under 35 U.S.C. 154(b) by 0 days.

(21) Appl. No.: 13/575,537

(22) PCT Filed: Feb. 3, 2011

(86) PCT No.: PCT/CZ2011/000013

§ 371 (c)(1),
(2), (4) Date: Jul. 26, 2012

(87) PCT Pub. No.: WO2011/095141

PCT Pub. Date: Aug. 11, 2011

(65) Prior Publication Data

US 2012/0301567 A1 Nov. 29, 2012

(30) Foreign Application Priority Data

Feb. 5, 2010 (CZ) ..... PV 2010-93

(51) Int. Cl.
*B27N 3/14* (2006.01)

(52) U.S. Cl.
USPC ..... 425/174.8 E; 425/66; 425/174; 425/447; 425/449; 425/174.8 R; 264/449; 264/451; 264/452; 264/465; 264/467; 264/484

(58) Field of Classification Search
USPC ..... 425/66, 174, 447, 449, 178.8 R, 178.8 E; 264/449, 451, 452, 465, 467, 484
See application file for complete search history.

(56) References Cited

U.S. PATENT DOCUMENTS 692,631 A 2/1902 Cooley
705,691 A 7/1902 Morton (Continued)

FOREIGN PATENT DOCUMENTS

EP 2045375 A1 4/2009
WO 2009049564 A2 4/2009
WO 2009101472 A2 8/2009

OTHER PUBLICATIONS

Kumbar et al, Recent Patents on Electrospun Biomedical Nanostructures: An Overview, Recent Patents on Biomedical Engineering 2008, vol. 1, pp. 68-78.

(Continued)

*Primary Examiner* — Timothy Kennedy
*Assistant Examiner* — David N Brown, II
(74) *Attorney, Agent, or Firm* — Wood, Herron & Evans, LLP

(57) ABSTRACT

An apparatus for a production of two-dimensional or three-dimensional fibrous materials of microfibers or nanofibers containing a set of spinning metal nozzles connected to a first potential, a set of electrodes of a collector facing the set of the nozzles, arranged at regular spacing and connected to a second potential, and a collecting plate or a collecting cylinder for collecting microfibers or nanofibers settled between couples of adjacent electrodes of the collector. The substance of the invention is as follows: the set of the electrodes of the collector contains at least two electrodes of the collector arranged in a plane and the collecting plate in line of its intersection or a tangent to the collecting cylinder, that is perpendicular to a contact line with the plane of the electrodes of the collector, form with the plane of the electrodes of the collector an angle α, the size of which ranging between 0° and 90°, the collecting plate or the collecting cylinder being supported movably in relation to the electrodes of the collector in a direction lying in the plane that is perpendicular to the plane of the electrodes of the collector and in which the axis of the electrode lies, the direction of the collecting plate or the collecting cylinder movement forming with this electrode axis an angle β, the size of which ranging between 0° and 90°. Such arrangement enables creating of large areal and voluminous objects of ordered nanofibers.

10 Claims, 11 Drawing Sheets

(56) References Cited

U.S. PATENT DOCUMENTS

| | | | | |
|---|---|---|---|---|
| 2,048,651 | A | 7/1936 | Norton | |
| 4,323,525 | A * | 4/1982 | Bornat | 264/441 |
| 4,689,186 | A * | 8/1987 | Bornat | 264/6 |
| 2005/0104258 | A1 | 5/2005 | Lennhoff | |
| 2007/0152378 | A1* | 7/2007 | Kim | 264/465 |
| 2011/0101571 | A1* | 5/2011 | Reneker | 264/465 |

OTHER PUBLICATIONS

Li et al., Electrospinning of Polymeric and Ceramic Nanofibers as Uniaxially Aligned Arrays, Nano Letters 2003, vol. 3, No. 8. pp. 1167-1171.

Li et al, Electrospinning Nanofibers as Uniaxially Aligned Arrays and Layer-by-Layer Stacked Films, Adv. Mater. 2004, vol. 16, No. 4, Feb. 17, pp. 361-366.

Li et al, Collecting Electrospun Nanofibers with Patterned Electrodes, Nano Letters 2005, vol. 5, No. 5, pp. 913-916.

Jalili et al., Fundamental Parameters Affecting Electrospinning of PAN Nanofibers as Uniaxially Aligned Fibers, Journal of Applied Polymer Science, 2006, vol. 101, pp. 4350-4357.

International Preliminary Report on Patentability issued in corresponding PCT/CZ2011/000013, dated Aug. 7, 2012 (7 pages).

International Search Report issued in corresponding PCT/CZ2011/000013, Jul. 13, 2011 (3 pages).

* cited by examiner

APPARATUS FOR PRODUCTION OF TWO-DIMENSIONAL OR THREE-DIMENSIONAL FIBROUS MATERIALS OF MICROFIBRES AND NANOFIBRES

TECHNICAL FIELD

The present invention refers to an apparatus for a production of two-dimensional and three-dimensional fibrous materials, of microfibers and nanofibers comprising a set of spinning nozzles attached to a first potential, a first set of electrodes facing the set of nozzles which are arranged having regular mutual spacing and attached to a second potential, and a collecting plate for collecting microfibers or nanofibers settled between couples of adjacent electrodes.

BACKGROUND OF THE INVENTION

Hitherto known apparatuses for production of microfibers and nanofibers working on principle of electrostatic field of very high intensity, the effects of which form melt or solution of polymers into fibrous structures, use plate collecting electrodes most frequently. The first methods of polymers spinning have been patented as far back as at the beginning of the $20^{th}$ century U.S. Pat. No. 0,705,691 (1900), U.S. Pat. No. 0,692,631 (1902), U.S. Pat. No. 2,048,651 (1934) as reported in Recent Patents on Biomedical Engineering 1, 68-78 (2008), by Kumbar et al. Individual fibers deposited onto such a plate electrode are placed at random, i.e. they are not placed in any preferred direction. It is because of an unstable phase of a moving polymer jet, the trajectory of which is very complicated and spatially chaotic before its incidence onto the collecting electrode.

If the material produced is composed of regularly arranged microfibers or nanofibers, applications of such materials can spread boundlessly also in many new modern fields and branches. Their promising potential consists in substantial improvement of their morphological properties and consequently mechanical, physiological, biological, physical, optical and chemical properties, namely in particular thanks to their internal regularly oriented structure.

Several publications deal with principals of providing the arrangement of fibers deposited in this way. Two basic methods are known. The first one utilizes a mechanical principle of winding fibers onto a cylinder, bar or disc, rotating at high revs. The second principle, which this invention also refers to, utilizes static gathering collector divided into two or more conductive parts, separated from each other by a non-conductive gap of a definite size. The collector shapes the lines of force of an acting electrostatic field. The trajectory of the polymer jet is determined by these electrostatic forces and fibers falling onto the gathering collector are deposited parallel to each other in preferred direction in the non-conductive areas of the divided collector. The structure of the conductive and non-conductive areas of the collector defines the acting electrostatic forces, influencing hitherto random flight of the polymer jet, and thus it controls its movement. The mechanism of the ordered depositing of fibers onto the collector can be deduced from systematic experimental studies or numerical simulations of a physical model. In principal these methods work successfully. In 2003-2005, Dan Li et al. published the principle discussed above in professional journals, including Nano Letters 3 (8), 1167-1171 (2003), Advanced Materials 16 (4), 361-366 (2004), and Nano Letters 5 (5), 913-916 (2005).

The production of planar (2D) or voluminous (3D) materials using similar apparatuses is significantly limited and it is not possible to produce larger 2D and thicker 3D materials having regular structure. Thus the production is restricted to manufacturing of individual oriented fibers only. Ordered micro- or nanofibers are deposited onto non-conductive areas of the divided collector, where they form a fine regular layer. The divided collector consists of conductive usually metallic links separated by non-conductive backplate having high resistivity (higher than $10^{16}$ (Ω·cm). Fibers deposited onto such gathering collector are mechanically connected with it, so that any further independent practical use of them is limited. Positioning of an underlying substrate on the divided collector, or rather between emitter and collector, leads to a degradation of the structured electrostatic forces, the effects of which take part in the formation of fibers orientation. For an application of materials produced by this method, the resulting layer has to be taken from the collector first and transferred.

Rouhollaha Jalili et al. (Journal of Applied Polymer Science 101 (6), 4350-4357 (2006)) describe a simple collector for an accumulation of several oriented fibers into a common bundle. The result of it is not a planar structure but the bundle of fibers, only. Such fiber sample was prepared solely for the purpose of subsequent X-ray and mechanical analyses of the bundle properties. Practical use of the several fibers bundle is not mentioned in Jalili et al., and due to the achieved dimensions (length of 30 mm and diameter of about 0.08 mm), it may be assumed that it is not significant.

Patent applications US2005-0104258A1 and PPVCZ2007-0727A3 discuss a collecting electrode structure generating singular charges, but they do not deal with any ordered formation and orientation of fibers. A divided collector is a part of a U.S. Pat. No. 4,689,186, but it is used for different purposes and it is not directly involved in any formation of oriented fibers. Patent application EP2045375A1 describes an apparatus for production of 2D or 3D materials composed of micro- or nanofibers with regular structure using an electrically divided collector of cylindrical shape, during a rotation of which oriented fibers are collected. By means of the described solution it is possible to produce materials with a restricted dimension that is partly limited by the diameter of the rotating collector. Also an implementation of the apparatus for producing materials of this type with larger area (i.e. multiple repeating of the proposed solution) is practically complicated, line restricted and therefore ineffective.

Micro- or nanofibers of lower strength, especially fibers made of biopolymers, are being torn by their own gravity between the collector electrodes when thicker layers (2D or 3D) are to be formed and thus the whole structure is being impaired. This is limiting for any production technology and for getting applicable materials having desired parameters.

When depositing fibers in thicker layers, a degradation of an orientation level occurs and fibers arrangement becomes more random again. It is caused by a progressive increase of electric charge in the formed layers of fibers, i.e. in those collector parts that should remain non-conductive and without electric charge, to enable correct functioning of the fiber orienting principle. This negative effect brings about depositing of oriented fibers in lower layers of material only, i.e. in those layers which were deposited first at the beginning of the deposition; on the other hand fibers with random arrangement prevail in the higher layers. For that reason a structure of a gathering collector and an automatic mechanism were designed, where the automatic mechanism withdraws thin deposited layers of micro- or nanofibers and superimposes them in thicker layers (2D or 3D) simultaneously with the spinning process.

SUMMARY OF THE INVENTION

It is an object of the present invention to enable a control of morphological properties and other properties resulting from them of produced micro- or nanofibrous materials, and thereby to get better, also anisotropic, properties of these new materials. Resulting properties of the produced fibrous materials, especially the degree of fibrous structures orientation, morphology, density, porosity, and mechanical, physical, biological and chemical properties, are influenced by means of the process parameters. The new materials have large macroscopic dimensions in the form of planar (2D) or voluminous (3D) objects. Various starting materials, preferably polymers, namely synthetic or natural, can be used for a spinning process leading to the production of micro- or nanofibers.

This object is achieved by an apparatus for production of two-dimensional or three-dimensional fibrous materials of microfibers or nanofibers comprising a set of spinning nozzles connected to a first potential, a set of electrodes facing the set of the nozzles arranged at regular spacing and connected to a second potential, and a collecting plate for collecting microfibers or nanofibers settled between couples of adjacent electrodes, where the substance of the invention is as follows: the set of the electrodes comprises at least two electrodes arranged in a plane and the collecting plate and the plane of the electrodes form an angle $\alpha$, the size of which ranging between 0° and 90°, the collecting plate being, in relation to the electrodes, supported movably in the direction lying in that plane perpendicular to the plane of the electrodes, in which the axis of the electrode lies, the direction of the collecting plate movement forming with this electrode axis an angle $\beta$, the size of which ranging between 0° and 90°.

In an advantageous embodiment of the apparatus for the production of two-dimensional or three-dimensional fibrous materials of micro- or nanofibers according to the present invention, the collecting plate bears on the electrodes with an edge provided with a blade.

In another advantageous embodiment of this apparatus the collecting plate is provided with open parallel gaps; each of them being arranged facing one of the electrodes, whereas the collecting plate parts between two adjacent gaps are inserted into a space between two adjacent electrodes.

In a further advantageous embodiment of this apparatus, the set of the electrodes arranged at regular spacing contains at least three parallel electrodes.

In yet another advantageous embodiment of this apparatus, the collecting plate is covered with a removable substrate on its surface turned away from the electrodes to enable the nanofiber layer being enfolded with this substrate.

Finally in yet another advantageous embodiment of this apparatus, the collecting plate is provided with recess on its surface turned away from the electrodes for placing the nanofiber layers collected by the collecting plate.

BRIEF DESCRIPTION OF THE DRAWINGS

The present invention will now be explained in more detail with reference to the accompanying drawings, wherein.

DETAILED DESCRIPTION OF THE DRAWINGS

Figure 1:
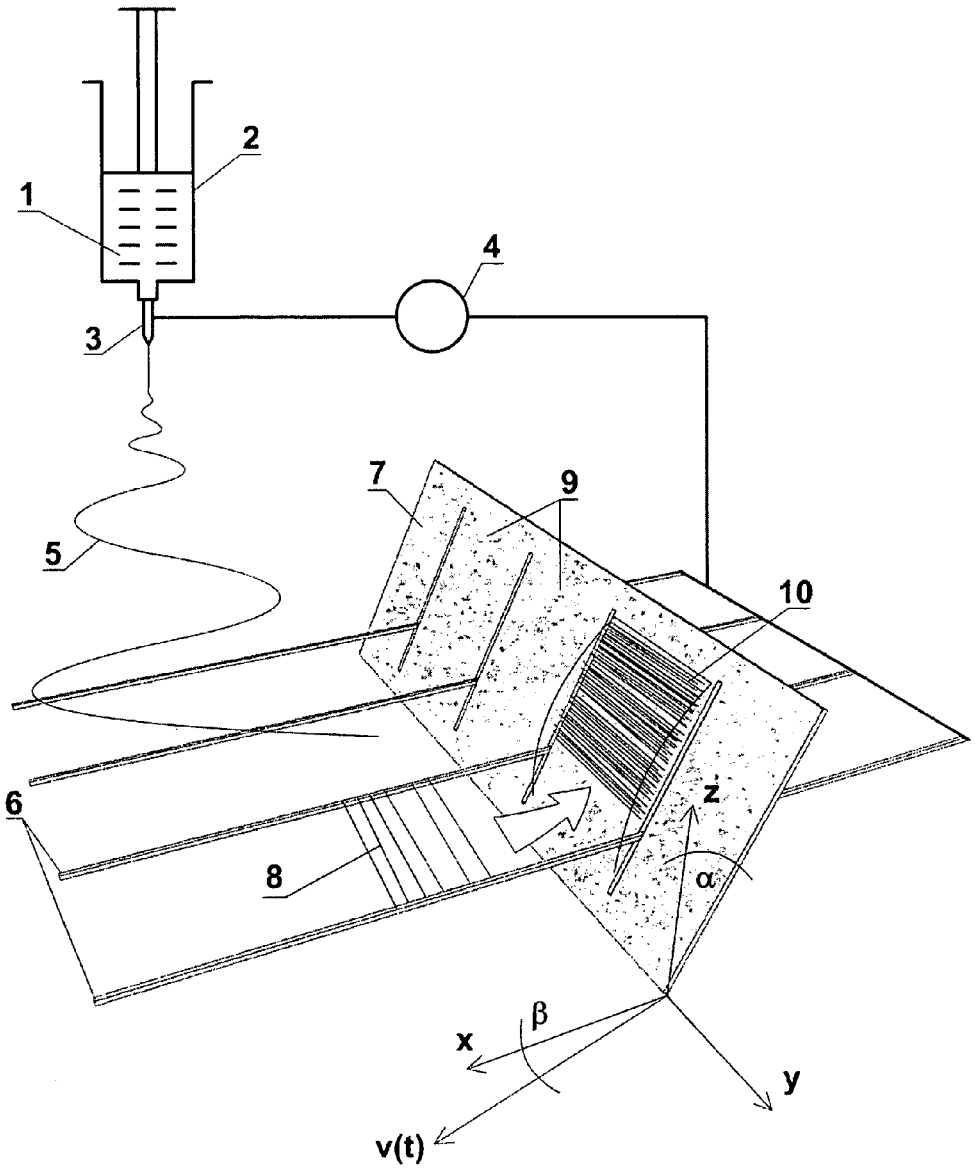
FIG. 1 is a schematic drawing of the first exemplary embodiment of an apparatus for a production of two-dimensional or three-dimensional fibrous materials of microfibers or nanofibers according to the present invention, with collector electrodes in the form of linear parallel guide bars.

Reference is now made to FIG. 1 wherein the first exemplary embodiment of the apparatus for the production of two-dimensional or three-dimensional fibrous materials of microfibers or nanofibers is schematically depicted. A nozzle emitter 2 is filled with a polymer 1 solution and one pole of a DC voltage source 4 is connected to its metal nozzle 3, wherein the other pole of the source 4 is connected to conductive bar electrodes 6 of a collector. The conductive bars of the electrodes 6 of the collector pass through gaps provided in a collecting plate 7 which is inclined with respect to an x-axis by angle $\alpha$. The conductive bars of the electrodes 6 of the collector are arranged in x-y plane and are linear and parallel to each other.

When the apparatus is in operation, the polymer solution 1 is extruded by a mechanical piston through the metal nozzle 3. High DC voltage from the source 4 supplied between the nozzle 3 and the electrodes 6 of the collector (the electrodes being in a form of conductive bars) directs a polymer jet as a fiber 5 which moves from the nozzle 3 in the direction towards the collector (i.e. in the direction of z-axis) on a random trajectory. This fiber 5 solidifies into a form of a micro- or nanofiber prior to its impact on the collector. Electrostatic forces acting on the fiber 5 will influence its deposition in a preferred direction 8 which is in this case the direction of y-axis, the y-axis direction being perpendicular to the conductive bars of the electrodes 6 of the collector arranged in x-y plane. The collecting plate 7, inclined by an angle $\alpha$ relative to the x-axis, performs translational movement in a direction v(t) during defined time intervals, the direction v(t) forming an angle $\beta$ with x-axis. During the movement of the collecting plate 7, the fibers 5 are spontaneously deposited onto areas 9 having sizes $S_i=l_i \cdot w_i$. The oriented fibers 5 form a new planar (2D) or voluminous (3D) material 10.

Figure 2:
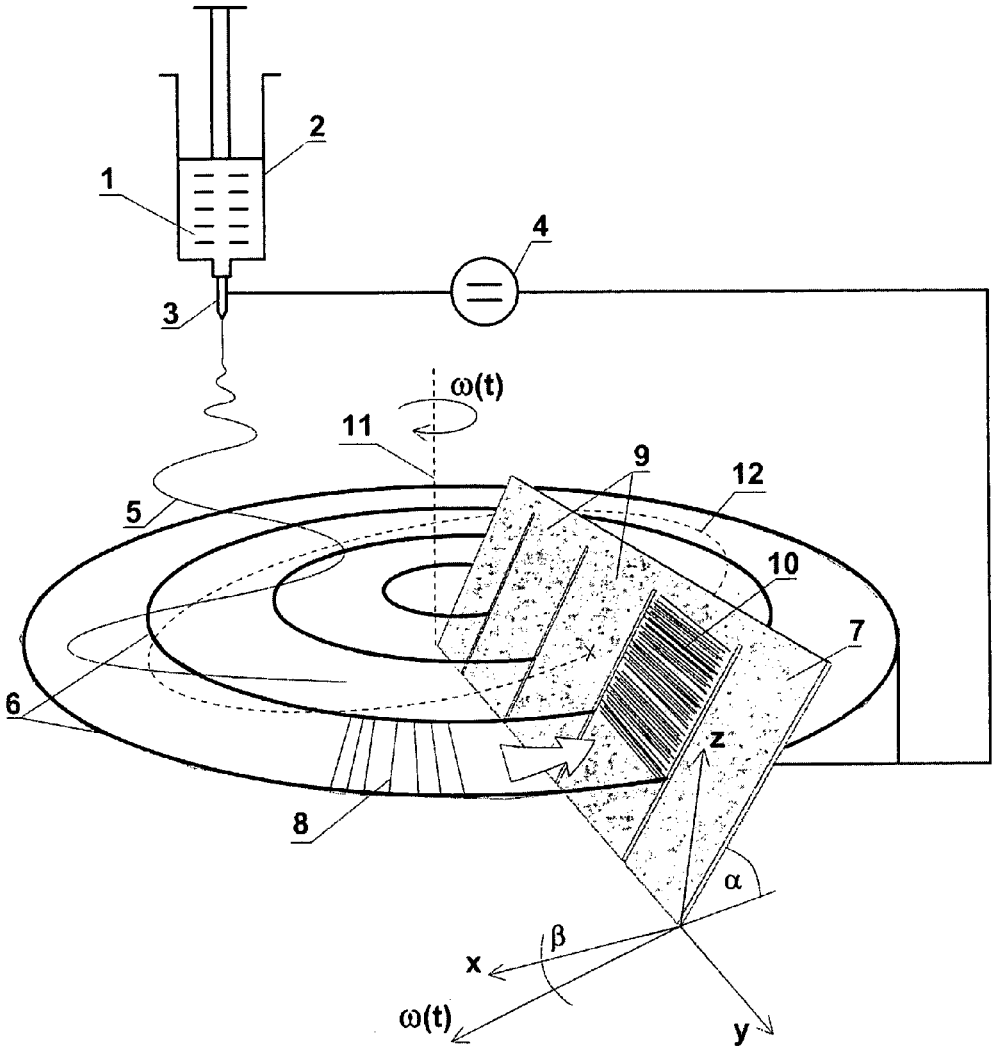
FIG. 2 is a schematic drawing of the second exemplary embodiment of an apparatus for production of two-dimensional or three-dimensional fibrous materials of microfibers or nanofibers according to the present invention, with the collector electrodes in the form of concentric circular guide bars arranged in a plane.

Reference is now made to FIG. 2 wherein the second exemplary embodiment of the apparatus for a production of two-dimensional or three-dimensional fibrous materials of microfibers or nanofibers according to the present invention is schematically depicted with collector electrodes 6 in the form of concentric circular guide bars arranged in a plane. A nozzle emitter 2 is filled with a polymer solution 1 and one pole of a DC voltage source 4 is connected to its metal nozzle 3. The other pole of the source 4 is connected to the electrodes 6 of the collector. The conductive bars of the electrode 6 of the collector pass through gaps provided in the collecting plate 7 which is inclined by an angle α relative the x-axis. The conductive bars of the electrodes 6 of the collector are arranged in the x-y plane and they have the form of concentric circles.

Figure 3:
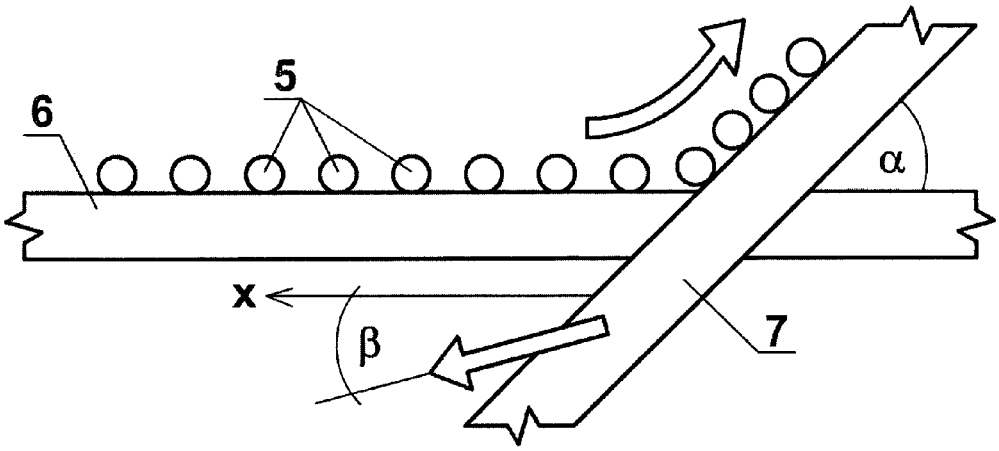
FIG. 3 is a schematic side view of a collecting mechanism with a planar collecting plate.

When the apparatus is in operation, the polymer solution 1 is extruded by a mechanical piston of the nozzle emitter 2 through the metal nozzle 3. High voltage DC between the nozzle 3 and the electrodes 6 of the collector directs a polymer jet of a fiber 5 that moves from the nozzle 3 in the direction to the collector (i.e. in the direction of z-axis) on random trajectory. This jet of polymer fiber 5 solidifies into the form of a micro- or nanofiber before its impact on the collector. The electrostatic forces acting on the fiber 5 influence its deposition in a preferred direction 8, which is radial in relation to the circular conductive bars of the electrodes 6 of the collector, arranged in the x-y plane. The collecting plate 7, which is inclined by ab angle α relative to the x-axis, moves in specified time intervals rotating around its vertical axis 11 in a direction ω(t), whereas the collecting plate mass centre describes a circle 12 which is inclined by an angle β relative to the x-axis. During this movement of the collecting plate, the fibers are spontaneously deposited onto areas 9. The oriented fibers 5 form a new planar (2D) or voluminous (3D) material 10. A schematic side view of the collecting mechanism with a planar collecting plate 7 is schematically depicted in FIG. 3. Fibers 5 are deposited on the conductive bars of the electrodes 6 of the collector by the electrostatic spinning process. Afterwards the fibers are placed on the collecting plate 7 surface whereas their orientation remains preserved. In this exemplary embodiment, the collecting plate 7 is planar and it is inclined by an angle α with respect to the bars of the electrodes 6 of the collector and it performs a translational movement in a direction which forms an angle β with the x-axis.

Figure 4:
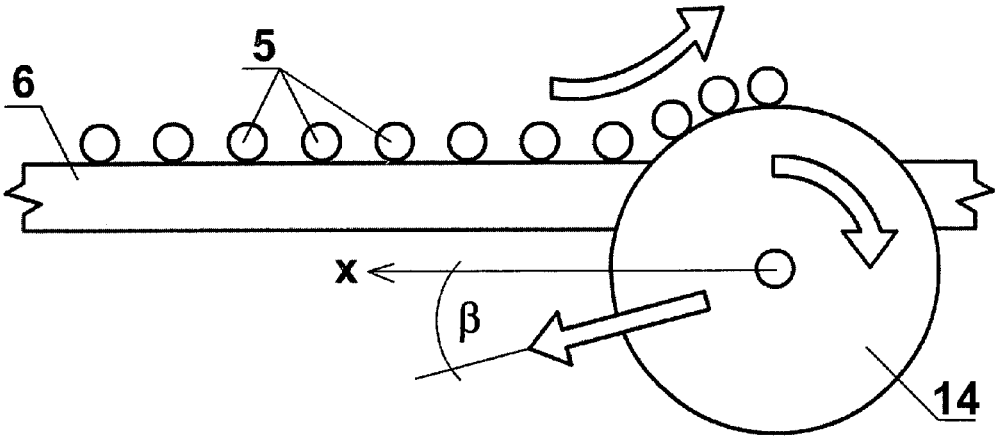
FIG. 4 is a schematic side view of a collecting mechanism with a collecting cylinder.

A side view of a collecting mechanism with a collecting cylinder 14 is schematically depicted in FIG. 4. Fibers 5 are deposited on the conductive bars of the electrodes 6 of the collector by the electrostatic spinning process. Afterwards the fibers 5 are placed on the collecting cylinder 4 surface, whereas their orientation remains preserved. The collecting cylinder 14 rotates around its axis and it performs a translational movement along the x-axis at the same time.

Figure 5:
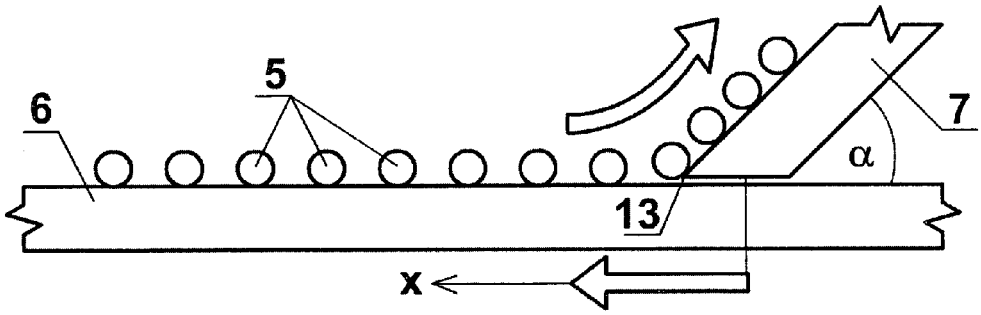
FIG. 5 is a schematic side view of a collecting mechanism with a direct collection of fibers from the surface of the conductive bars by means of an inclined blade.

FIG. 5 shows a schematic side view of a collecting mechanism with a direct collection of fibers 5 from the surface of the conductive bars of the electrodes 6 of the collector by means of an inclined blade. Fibers 5 are deposited on the conductive bar electrodes 6 of the collector by the electrostatic spinning process. Afterwards the fibers 5 are placed on a surface of the collecting plate 7, whereas their orientation remains preserved. In this exemplary embodiment the fibers 5 are collected directly from the surface of the conductive bars of the electrodes 6 of the collector by means of an inclined blade 13. The blade 13 is inclined by an angle α with respect to the conductive bars of the electrodes 6 of the collector and it performs a translational movement along the x-axis.

Figure 6:
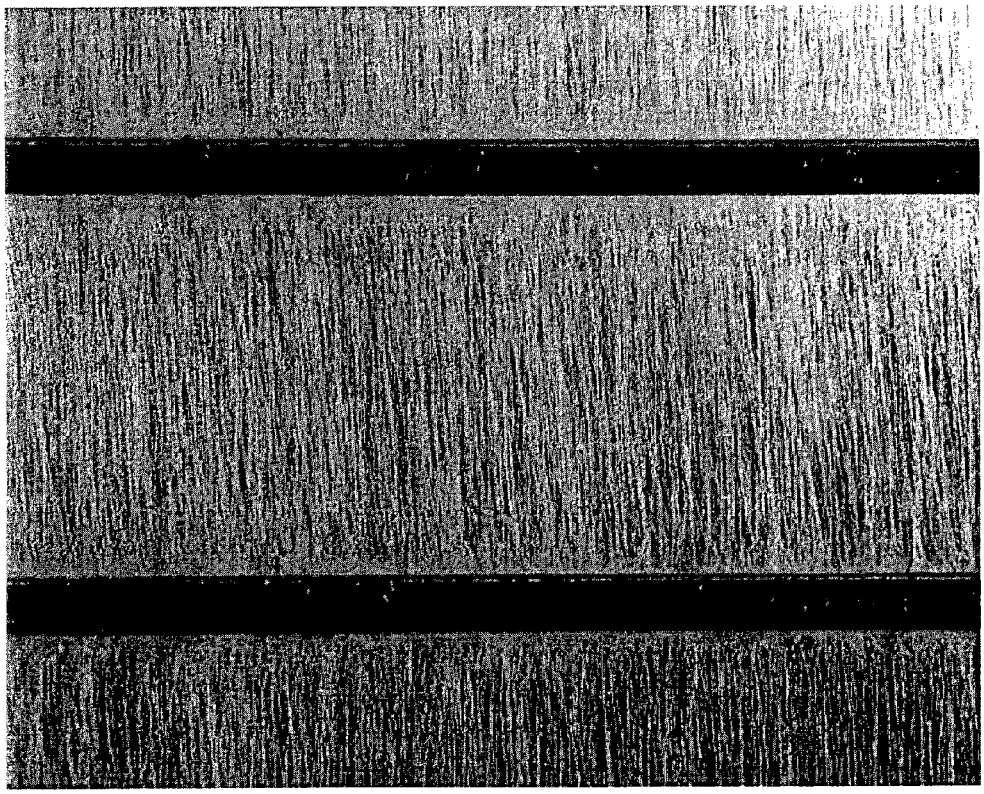
FIG. 6 is a photo of fibers deposited in orderly manner between the bar electrodes, separated by an air-gap, before their removal by a collecting plate from the apparatus according to the present invention.

FIG. 6 is a photo of fibers deposited in an orderly manner between the conductive bars of the electrodes 6 of the collector separated with an air-gap, prior to their removal by means of the collecting plate. It is evident from the FIG. 6 that the nanofibers are arranged in parallel.

Figure 7:
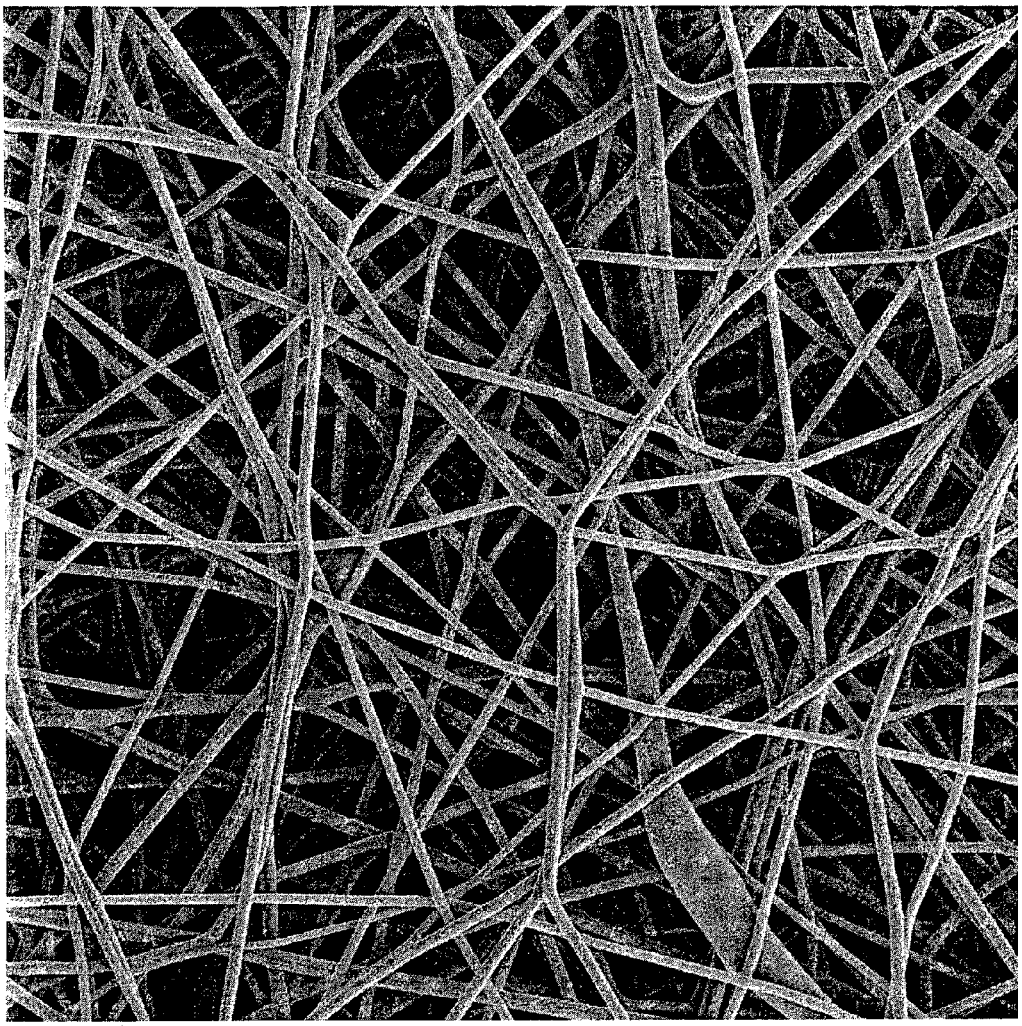
FIG. 7 is a photo of randomly arranged fibers deposited on the plate collector.
Figure 8:
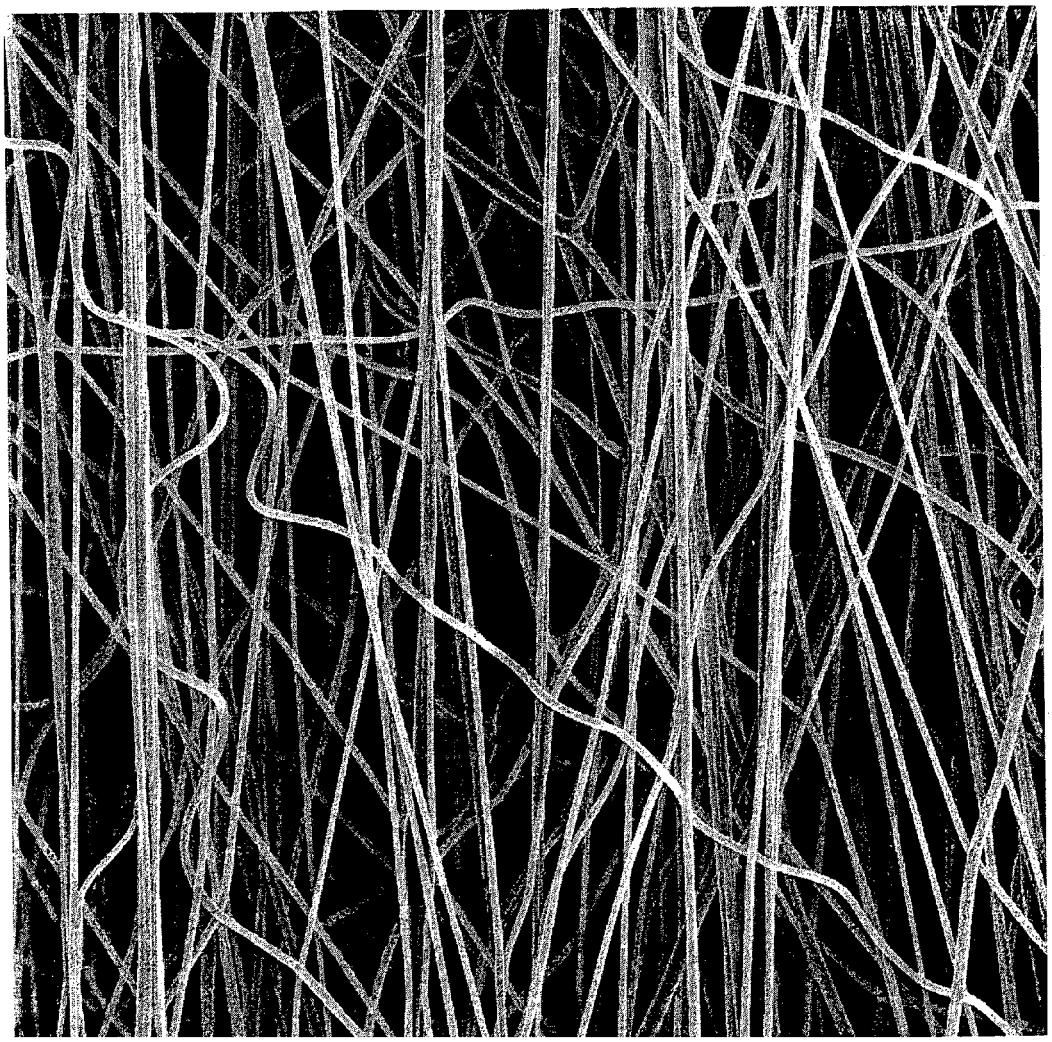
FIG. 8 is a photo of partially oriented fibers deposited on an electrically divided collector.
Figure 9:
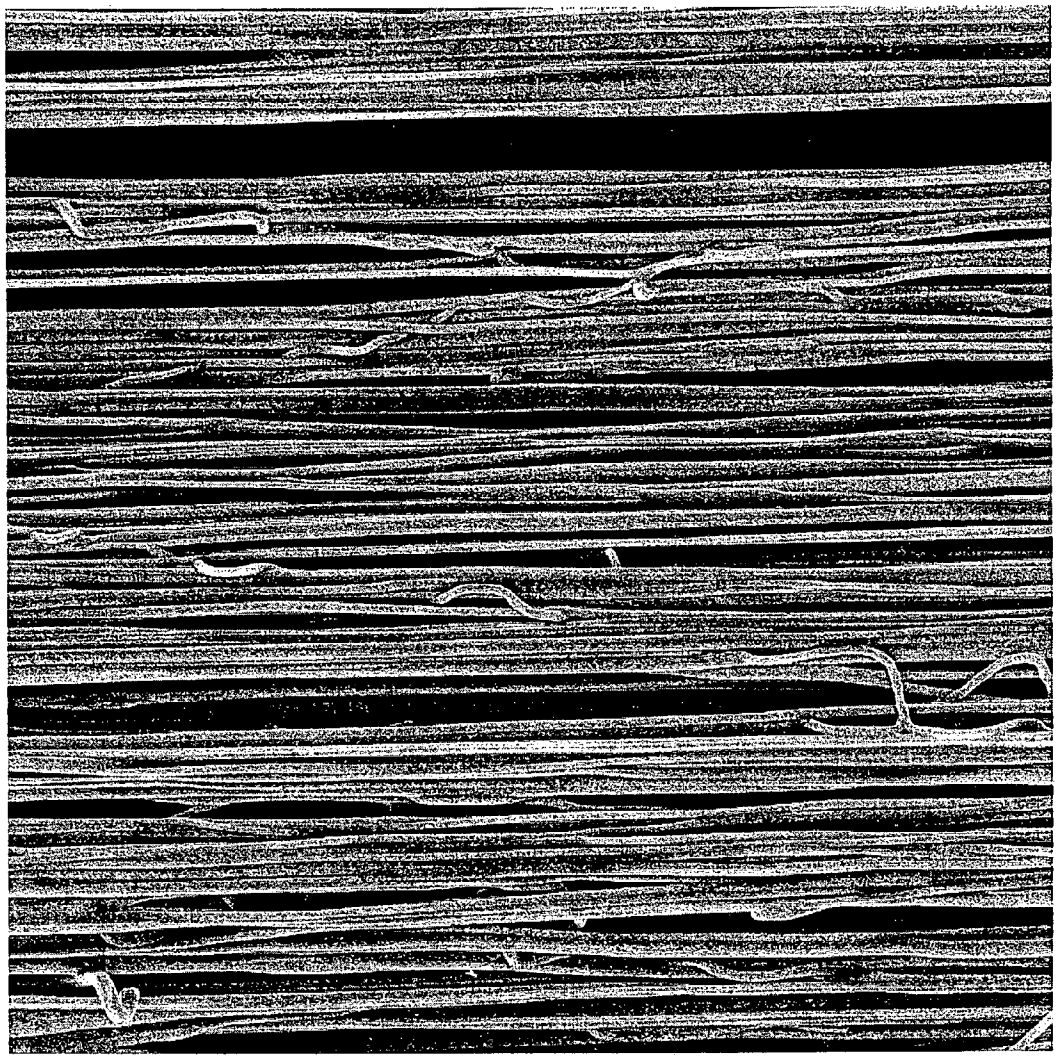
FIG. 9 is a photo of oriented fibers being consecutively withdrawn from the divided collector in accordance with the present invention.

FIGS. 7, 8 and 9 are photos illustrating the importance of the gathering collector design and of the method of a consecutive depositing on nanofibers of polyvinylalcohol. The photos were taken by an electron microscope with magnification approx. 5000×. In FIG. 7, fibers 5 applied onto a plate collector are deposited at random; in FIG. 8, fibers 5 deposited onto electrically divided collector are partly oriented, and FIG. 9 is a photo of oriented fibers 5 witch have been consecutively removed from the divided collector according to the present invention.

Figure 10:
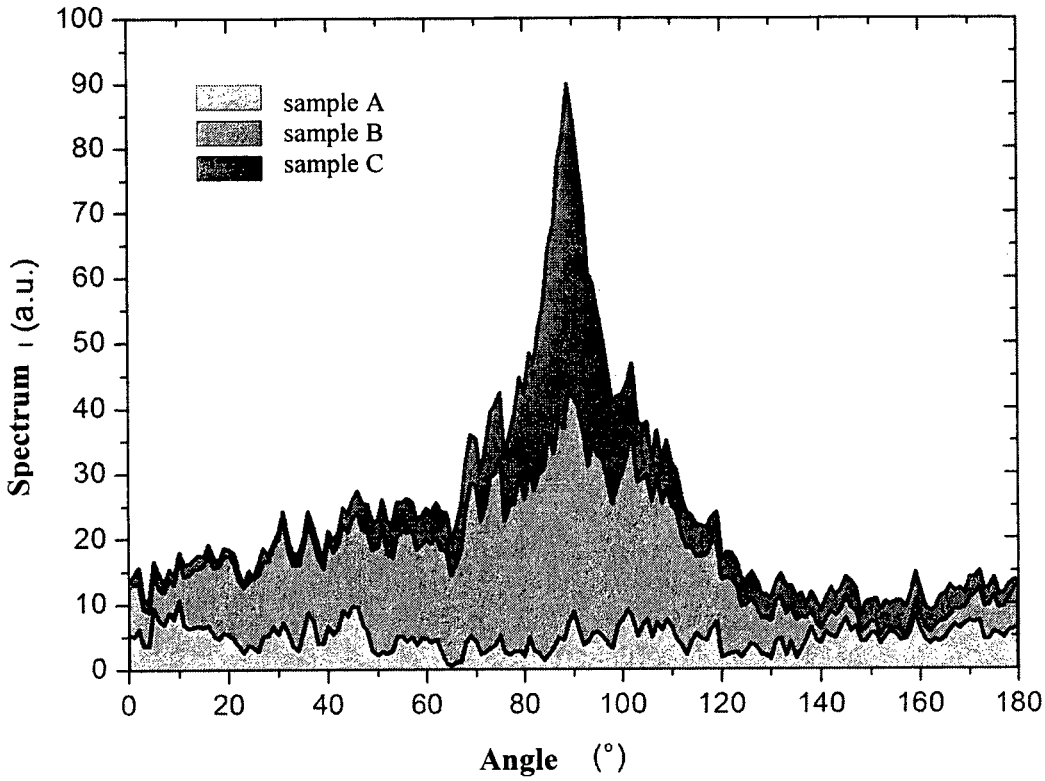
FIG. 10 is an angular spectrum representing fibers orientation corresponding to FIGS. 7, 8 and 9, and FIGS. 11*a*, 11*b*, and 11*c* are examples of a material made of polyvinylalcohol fibers using the apparatus according to the present invention, magnified 70×, 350× and 3700×, respectively.

FIG. 10 shows an angular spectrum diagram representing the orientation of the fibers 5 of the samples shown in FIG. 7 (sample A), FIG. 8 (sample B) and FIG. 9 (sample C). The spectrum was obtained on the basis of picture analysis by means of a Fourier transformation. The peak in the spectrum of the sample C corresponds to the most important angle of fibers 5 arrangement, in this case to angle of 90°—the vertical direction. The analysis applied is commonly used in professional practice for an automatic evaluation and comparison of fibers 5 orientation, even though the picture analysis works with dots, i.e. with picture pixels, not with individual fibers 5.

Figure 11A:
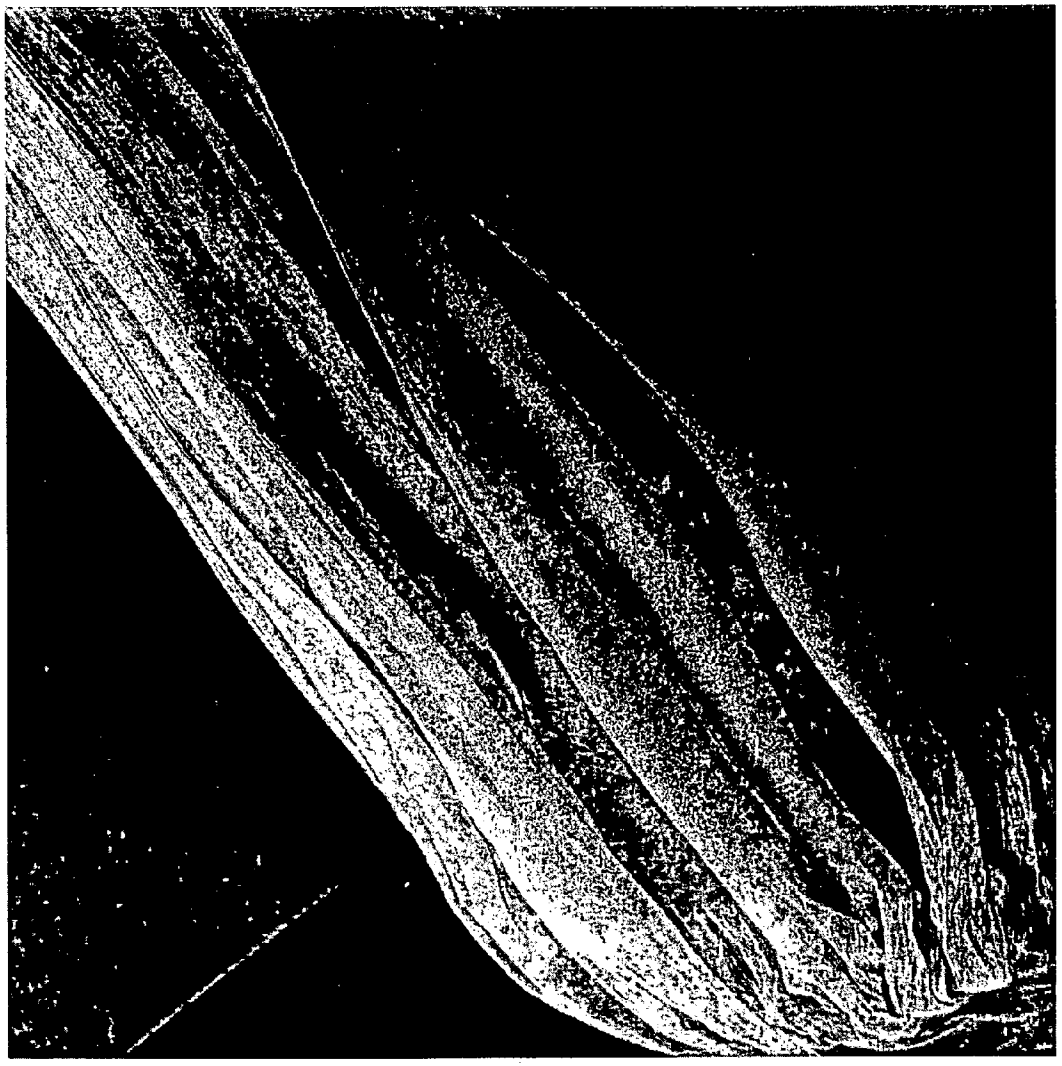
Figure 11B:
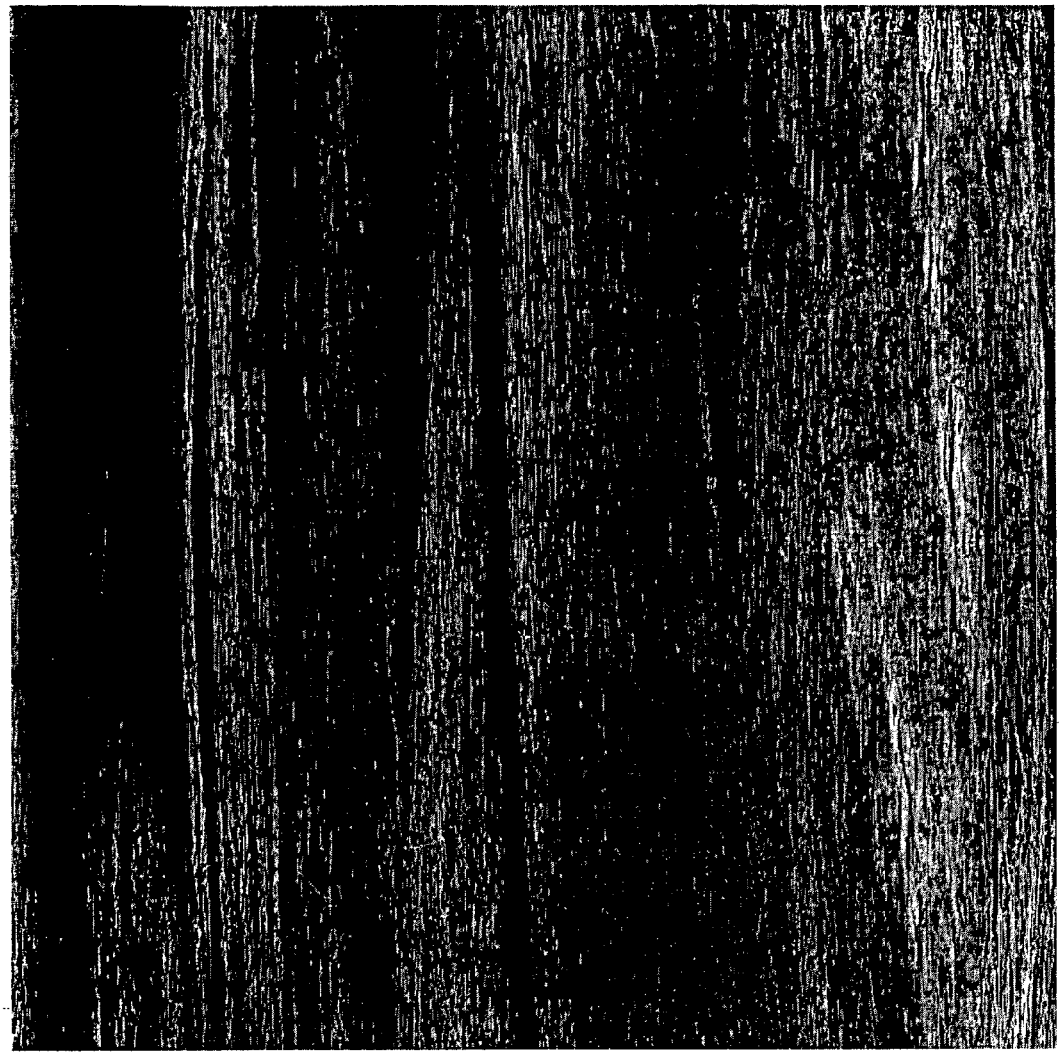
Figure 11C:
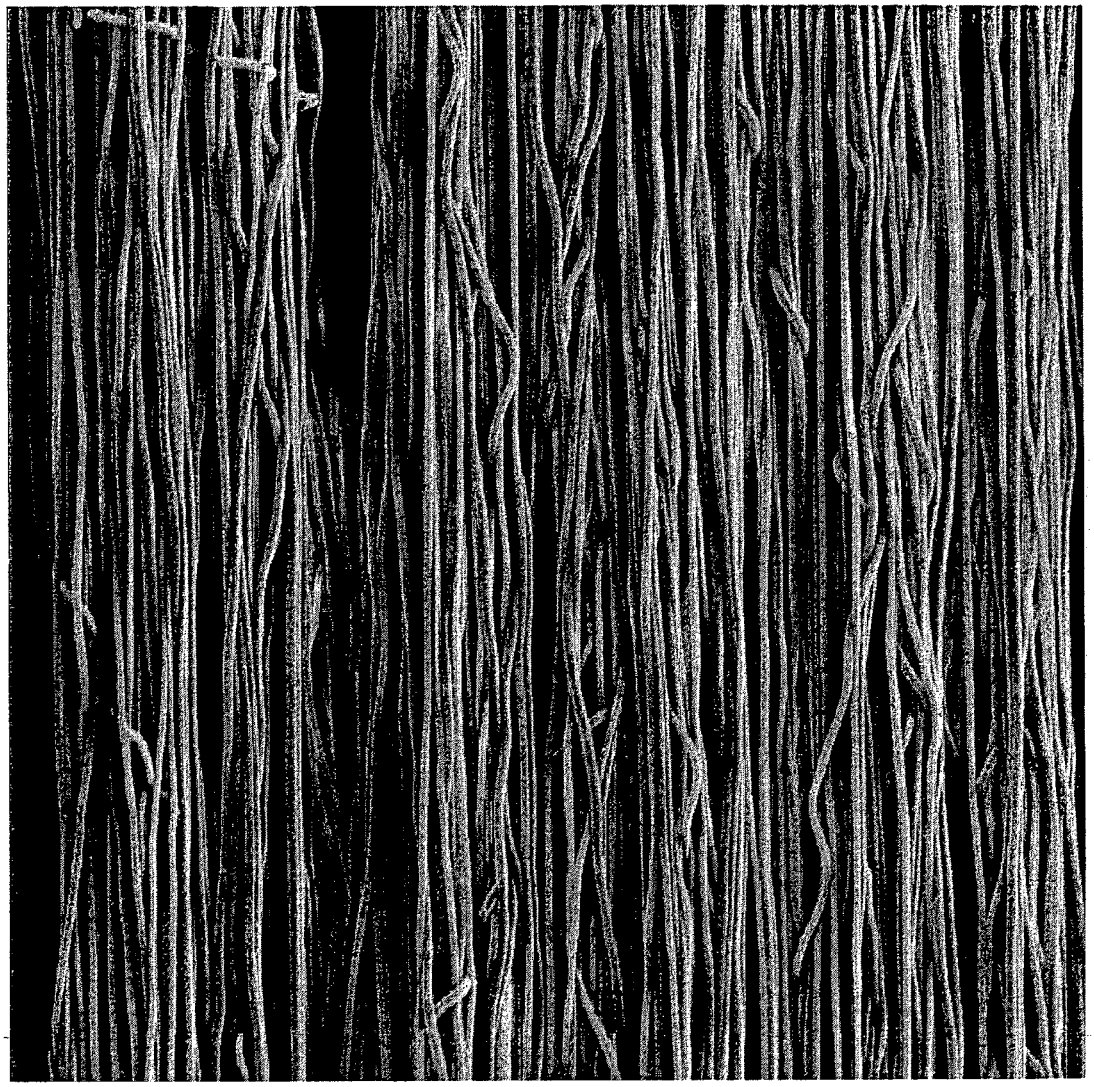

Photos of an exemplary material produced by means of the apparatus in accordance with the present invention are in FIGS. 11*a*-11*c*. There are three different magnifications of the material part of polyvinylalcohol fibers 5, namely magnification 70× in FIG. 11*a*, magnification 350× in FIG. 11*b* and magnification 3700× in FIG. 11*c*.

Micro- or nanofibers are formed by the method of electrostatic spinning. A single or a multiple nozzle emitter 2 generates a stream of polymer fibers 5 in a form of jets which move towards the second electrode 6 of the collector and uniformly cover the whole area of the collector. Micro- or nanofibers are carried away by electrostatic field forces and are deposited in parallel to each other, because—during their move from the nozzle emitter 2 towards the electrodes 6—their trajectory is influenced by lines of force of the electrostatic field in vicinity of the collector, which is for these purposes divided in two or more conductive and non-conductive areas. On the basis of numerous experiments a gathering collector was designed and tested wherein the electrodes 6 of the collector are constituted by two or more thin conductive bars, e.g. in the form of wires or strings, that are separated from each other by an air-gap. Neither their number nor their lengths are limited. It was further found that the most suitable shape of the bar section is not circular but angular, namely square or rectangular, having a width of 0.1 mm to 10 mm, preferably of 1 to 5 mm. Individual bars are laterally spaced apart from each other and separated by ab air-gap of a specified width, namely 0.1 mm to 200 mm, but more preferably 1 mm to 100 mm. The influence of the air-gap on the formation of ordered fibers 5 was studied systematically and it was found that in case of a short distance the degree of orientation is lowered. On the contrary in the case of a long distance, the fibers 5 are deposited directly onto the conductive electrodes and the number of oriented fibers 5 extended between the conductive bars is lower or the fibers are torn by their gravity. Therefore the most suitable size of the air-gap must be experimentally tested for each type of polymer to provide a successful formation of oriented fibers 5. It was further found that the width of the conductive bars need not necessarily be big, on the contrary, from the design and function points of view an application of thin bars of a square section proves to be advantageous in contrast to wider plates as it is shown in the literature cited. Sizes of the air-gaps were optimized for several sorts of synthetic and natural polymers depending on their mechanical properties.

The space between the conductive bars of the electrodes 6 of the collector, where the fibers 5 are being arranged longitudinally in one direction or rather perpendicularly to the conductive bars of the electrodes 6 of the collector across the non-conductive area, is gradually filled up during the deposition. The deposition of the fibers 5, oriented in this way, into the thicker layers is not possible for the reasons mentioned above, e.g. because of degradation of the orientation degree etc., and therefore a process has been proposed by which a thin deposited layer was withdrawn in regular time intervals and transferred onto a backplate, preferably simultaneously with the deposition.

For the oriented fibers 5 collecting, transferring and superimposing, the collecting plate 7 with elongated openings is used, the elongated openings enabling the collected plate 7 to be put on the conductive bars of the electrodes 6 of the collector and to move in translational movement in lengthwise direction along the conductive bars. The shape of the collecting plate 7 was repeatedly experimentally tested and modified. The resulting optimal design is described in this disclosure. During specified time intervals from 1 s to 1 hour, the collecting plate 7 shifts in a longitudinal direction along the conductive bars whereas it picks up the in orderly manner deposited micro- or nanofibers on its surface. It was found that due to the inclination of the collecting plate 7 by a specific angle relative to the bars of the electrodes 6 of the collector, namely $0°<\alpha<90°$, the fibers 5 withdrawn in the vicinity of edges of the conductive bars of the electrodes 6 of the collector are mechanically stressed to a lesser extent, and further that the inclination of the collecting plate 7 assists in regular deposition of individual fibers 5 along the whole of their length onto the collecting plate 7. The inclination of the collecting plate further enables simultaneous withdrawing of the fibers 5 deposited directly onto the conductive bars of the electrodes 6 of the collector. The fibers 5 are deposited in greater quantities in these places as a result of stronger acting electrostatic forces and therefore they increase the mechanical ruggedness of the resulting material. Furthermore the problem of the collection of oriented fibers 5 on a larger area $S=\Sigma S_i=\Sigma(l_i \cdot w_i)$ (where $l_i$ is length and $w_i$ is width of area i) has been solved, namely just by the newly designed and experimentally verified process. The collecting plate performs translational movement (at a speed of 0.001 m/s to 10 m/s) along the conductive bars of the electrodes 6 of the collector, the direction of this movement forming an angle $\beta$ (at interval $0°<\beta<90°$) with the conductive bars of the electrodes 6 of the collector. During this movement, the micro- or nanofibers deposited in an orderly manner are superimposed in thick layers (2D) or voluminous (3D) objects while the regular ordered structure of the material 10 is maintained. The value of the angle $\beta$ determines areal density of fibers 5 in the layer formed from the new material 10 and the length l of the collecting plate part that is covered with the fibers. The areal or voluminous materials 10 are created consecutively depending on an overall time of the process and an overall area of the produced material 10. The process developed enables depositing of micro- or nanofibers into thicker layers while the orientation degree being maintained even in higher layers. By placing on a prepared final backplate, fibers 5 are mechanically strained only to minimum degree and therefore their structure is not disturbed.

Fibers 5 manufactured of different mixtures, e.g. of synthetic or natural polymers, generally have different mechanical characteristics and materials 10 produced by electrostatic spinning have different morphology as well. On the basis of the examined characteristics, one of the proposed processes of collection and deposition of ordered fibers 5 was selected. It was found that the use of the collecting plate 7 which is inserted between the conducting bars of the electrodes 6 of the collector is suitable for fibers 5 with lower mechanical strength manufactured of natural polymers. Fibers 5 can be that fine that they may tear even by their own weight while being suspended between the conductive bars of the electrodes 6 of the collector. In such a case there is no other possibility than to take fibers 5 away by the apparatus in accordance with the present invention. On the contrary, a collecting plate 7 with a collecting blade 13 which performs translational movement over the surface of the conductive bars is used with more resistant materials 10 like synthetic polymers. The advantage of this process is that the resulting material 10 is not discontinued in any place and is even strengthened in areas on the conductive bars of the electrodes 6 of the collector which substantially increases its resistance in subsequent mechanical stress, e.g. in a specific application.

Translational movement of the collecting plate 7 along the conductive bars of the electrodes 6 of the collector is reverse during specific time intervals in order to form a one-sided deposit of the material 10. The new material 10 being created on an arbitrary backplate, the backplate can be designed as a packing material. A practical solution enables at production of ordered materials that will simultaneously be placed into a sterile packing in a deposition chamber "in situ" and thus will be ready for a direct application and use. The apparatus as designed solves a problem of a technically demanding mechanical transfer of fine fiber materials 10 onto another transport substrate and eliminates possible causes of disturbance, damage, pollution and deterioration of the material 10 during the manipulation. The apparatus as designed makes it possible to carry out the production process in the single environment of the deposition chamber and therefore a necessary sterility of materials 10 intended for medicine may be achieved easily.

In another case, the collecting plate 7 moves always in one direction only after expiration of a time interval. It remains in an end position for the same time interval and then moves back. The divided translational movement results in depositing of micro- or nanofibers from both sides of the collecting plate 7 which is adapted in its shape to attach underlying material. This principle makes it possible to create fiber layers on both sides of the only supporting backplate.

Further a problem of discrete movement of the collecting plate 7 has been dealt with, the problem being more demanding in terms of design. A centro symmetrical construction uses circular conductive bars of a collector as electrodes 6 of the collector. In this case, the collecting plate 7 rotates around its central ax. In this case the collecting plate moves at an angular velocity $\omega(t)$ ranging between 0.001 and 10 rad/s. Fibers 5 are deposited and layered in the same way as in the preceding embodiment. Here the continuous rotating movement of the collecting plate 7 is of advantage when compared with the discrete translations in the preceding solution.

Constructional modifications of the collecting plate 7 enable rotation of individual elements of the collecting plate 7 by an angle $\gamma$ lying in the range of $0<\gamma<90°$. After an expiration of a specific time interval (from 1 s to 1 hour) of a fiber material 10 layering, elements of the collecting plate 7, having areas $S_i=l_i \cdot w_i$, are slightly turned and further layers of the material 10 are deposited again. The inner structure of the material 10 formed in this way, has individual layers composed of micro- or nanofibers wherein the layers are slightly turned relative to each other by an adjusted angle $\gamma$. This principle makes it possible to produce materials 10 with two or more preferred directions of the anisotropic material 10 and to form an ordered 3D structure as well. The regular structure arises not only on the area but also in a three-dimensional object by the rotation of the collecting plate 7 elements or by multiple repeating of the fibers 5 collection in the process described above.

Deposited fibers 5 fill up the area between the gaps in the collecting plate 7. A size of the area 9 where the oriented micro- or nanofibers are layered is not dimensionally limited. The transverse width of the conductive bars of the electrodes 6 (and the width of the gaps in the collecting plate 7 derived from it) is the only important parameter. In these places fibers 5 in resulting material 10 are not deposited in an orderly manner or some spots here are left unfilled. There are maximum 20% of these areas in the resulting material 10.

Multiple metal nozzles 3 of the emitter are used for the purpose of covering a larger area of the collector with fibers 5 and increasing of the production efficiency. Individual metal nozzles 3 of the emitter are also used for the depositing of fibers 5 of different polymer mixtures. In case that the metal nozzles 3 of the emitter are positioned in line along the conductive bars of the electrodes 6 of the collector, fibers 5 are deposited in layers one after another whereas individual layers are created by the fibers 5 of different polymer. Fiber structure of the resulting material is of a composite type.

Replacement of the collecting plate 7 by a collecting cylinder 14 of a specific diameter R, in the lateral surface of which the gaps for individual conductive bars of the electrodes 6 of the collector are provided, enables a manufacturing of hollow tubes which walls are composed of fibers 5 arranged regularly in longitudinal direction. The collecting cylinder 14 performs two independent movements: a rotational movement around its longitudinal axis and a translational one in the direction along the conductive bars of the electrodes 6 of the collector (along x-axis). These movements of the cylinder enable collection of micro- or nanofibers onto its surface. The surface of the collecting cylinder 14 with a backplate, where the fibers are deposited into planar (2D) materials 10, is either left in tube shape or is spread out for the purpose of creating areal materials 10 of larger sizes.

The above described construction of the collector and the mechanism of the oriented micro- or nanofibers collection and deposition enable an efficient production of new materials that are areally large or layered in voluminous (3D) forms while their fine and regular fiber structure remains maintained.

The presented invention may be used for a production of areal (2D) or voluminous (3D) materials which have their inner fiber structure composed of oriented micro- or nanofibers arranged longitudinally in one or more directions.

The invention claimed is:

1. An apparatus for a production of two-dimensional or three-dimensional fibrous materials of microfibers or nanofibers comprising at least one spinning nozzle connected to a first potential, a set of electrodes of a collector, the set of electrodes facing the at least one spinning nozzle and being arranged having a constant spacing relative to each other and being connected to a second potential, and a collecting plate or a collecting cylinder for collecting microfibers or nanofibers settled between couples of adjacent electrodes of the collector, the collecting plate being provided with gaps through which the electrodes of the collector pass, wherein the set of electrodes of the collector contains at least two electrodes of the collector arranged in a plane and the collecting plate in the line of its intersection or a tangent to the collecting cylinder which is perpendicular to a contact line with the plane of the electrodes of the collector form with the plane of the electrodes of the collector an angle $\alpha$, the size of which ranges between 0° and 90°, the collecting plate or the collecting cylinder being moveable relative to the electrodes of the collector in a direction lying in a plane which is perpendicular to the plane of the electrodes of the collector and in which the axis of the electrode lies, while the direction of movement of the collecting plate or of the collecting cylinder forms with said electrode axis an angle $\beta$, the size of which ranges between 0° and 90°.

2. The apparatus for the production of two-dimensional or three-dimensional fibrous materials of microfibers or nanofibers according to claim 1, wherein the gaps in the collecting plate are arranged parallel with each other, and an area of the collecting plate between adjacent gaps is inserted into a space between two adjacent electrodes of the collector.

3. The apparatus for the production of two-dimensional or three-dimensional fibrous materials of microfibers or nanofibers according to claim 1, wherein the set of the electrodes of the collector having constant spacing relative to each other comprises at least three parallel electrodes of the collector.

4. The apparatus for the production of two-dimensional or three-dimensional fibrous materials of microfibers or nanofibers according to claim 1, wherein the collecting plate comprises a surface which is turned away from the electrodes of the collector, said surface being covered with a removable substrate to enable the microfiber or nanofiber layer to be enfolded by the substrate.

5. The apparatus for the production of two-dimensional or three-dimensional fibrous materials of microfibers or nanofibers according to claim 1, wherein the collecting plate comprises a surface which is turned away from the electrodes of the collector and which is provided with a recess for placing the microfiber or nanofiber layers collected by the collecting plate.

6. The apparatus for the production of two-dimensional or three-dimensional fibrous materials of microfibers or nanofibers according to claim 1, wherein the shape of the cross section of the electrodes of the collector is square or rectangular having a width of 0.1 mm to 10 mm.

7. The apparatus for the production of two-dimensional or three-dimensional fibrous materials of microfibers or nanofibers according to claim 6, wherein the shape of the cross section of the electrodes of the collector is square or rectangular having a width of 1 to 5 mm.

8. The apparatus for the production of two-dimensional or three-dimensional fibrous materials of microfibers or nanofibers according to claim 1, wherein the electrodes of the collector are laterally spaced from each other by an air-gap of between 0.1 mm and 200 mm.

9. The apparatus for the production of two-dimensional or three-dimensional fibrous materials of microfibers or nanofibers according to claim 8, wherein the electrodes of the collector are laterally spaced from each other by an air-gap of between 1 mm and 100 mm.

10. The apparatus for the production of two-dimensional or three-dimensional fibrous materials of microfibers or nanofibers according to claim 2, wherein the set of the electrodes of the collector having constant spacing relative to each other comprises at least three parallel electrodes of the collector.

* * * * *